United States Patent [19]

Rasmussen

[11] Patent Number: 4,964,495

[45] Date of Patent: Oct. 23, 1990

[54] PIVOTING TRAY FOR COIN SORTER

[75] Inventor: James M. Rasmussen, Chicago, Ill.

[73] Assignee: Cummins-Allison Corporation, Mt. Prospect, Ill.

[21] Appl. No.: 336,080

[22] Filed: Apr. 5, 1989

[51] Int. Cl.[5] ..... G07F 1/04

[52] U.S. Cl. ..... 194/344; 453/62; 222/166

[58] Field of Search ..... 453/3-15, 453/18, 61, 62; 194/320, 343, 348, 344; 222/162, 166

[56] References Cited

U.S. PATENT DOCUMENTS

| | | | |
|---|---|---|---|
| 1,793,886 | 2/1931 | Weber | 194/320 |
| 1,842,019 | 1/1932 | Godefroid | 453/9 |
| 4,086,928 | 5/1978 | Ristvedt et al. | 133/3 A |
| 4,383,540 | 5/1983 | DeMeyer et al. | 453/3 |
| 4,506,685 | 3/1985 | Childers | 133/3 A |
| 4,543,969 | 10/1985 | Rasmussen | 133/3 A |
| 4,549,561 | 10/1985 | Johnson et al. | 133/3 A |

FOREIGN PATENT DOCUMENTS

| | | | |
|---|---|---|---|
| 129570 | 2/1962 | Fed. Rep. of Germany | 453/9 |

OTHER PUBLICATIONS

Cummins Jet Sort Form No. 13C1211.
Cummins-Allison's JetSort Item No. 50-152, p. 25.
CA-750 JetSort Coin Processor Item No. 50-152 p. 26.
Cummins Model 3000 JetSort Form 023-1347-00.
Brandt Model 920/925.
Brandt System 930.
Brandt Model 940-6 High Speed Sorter/Counter B1-1801.
Brandt Model 945.
Brandt Model 952 Coin Sorter/Counter B1-1782A.
Brandt Model 954 Coin Sorter/Counter B1-1783.
Brandt 95 Series Coin Sorter/Counter B1-1866 (1982).
Brandt Model 957 Coin Sorter/Counter B1-1866C (1983).
Brandt Model 958 Coin Sorter/Counter B-1868 (1982).
Brandt Model 960 High Speed Coin Sorter & Counter 131-1894, (1984).
Brandt Model 966 Microsort (1979).
Brandt Model 970 Coin Sorter & Counter (1983).
Brandt Model 1205 Coin Sorter/Counter (1986).
Brandt Model 1400 Coin Sorter/Counter (1986).

*Primary Examiner*—F. J. Bartuska
*Attorney, Agent, or Firm*—Arnold, White & Durkee

[57] ABSTRACT

In the field of coin handling, and particularly coin sorting, it is important to keep different batches of coins separated from one another. A problem arises during the transfer of a batch of coins from a coin tray through an opening and into the coin sorting mechanism, because different batches of coins can inadvertently be mixed if the opening is not adequately protected. To solve this problem, a coin tray is provided that includes a coin holding portion which is adapted to be pivotally mounted on the coin sorter. The coin tray pivots between a coin holding position and a coin transferring position, and has an opening therein which allows coins to pass through the coin holding portion to the coin sorting mechanism. A barrier portion prevents coins on the coin holding portion from entering the opening when the coin holding portion is in the coin holding position. The barrier portion borders the opening, and is preferably stationary with respect to the coin handling machine. When the coin holding portion is lifted into the coin transferring position, the barrier portion allows coins on the coin holding portion to enter the opening because the coin holding portion is higher than the barrier portion. The interior of the barrier portion forms a chute which guides coins through the opening and into the coin handling mechanism.

4 Claims, 2 Drawing Sheets

PIVOTING TRAY FOR COIN SORTER

BACKGROUND OF THE INVENTION

1. Field of the Invention

This invention relates generally to coin trays for coin sorters, and more particularly to a pivoting coin tray.

2. Description of the Related Art

A coin sorter typically has a stationary coin tray which holds a batch of coins before or during sorting. The coin tray includes an opening which leads to the sorting mechanism. Coins in the tray flow or are scraped toward the opening to supply the sorting mechanism with a steady flow of coins.

Frequently in coin sorting operations, certain batches of coins are associated with a particular installation or individual. A courier who is responsible for retrieving coins from a route which includes a number of vending machines or coin-operated laundry facilities, for instance, verifies the amount of coins collected on a particular route with a coin sorter. Coin sorters are most commonly found in banks and other high volume installations which process many batches of coins per day. In these high volume installations, operators commonly process batch after batch as various couriers deposit coins collected on their routes.

It is important that the different batches of coins remain separated from one another so that an accurate accounting of a particular route or facility may be kept. To prevent the inadvertent mixing of different batches of coins, some type of closure is required to keep the different batches separated from one another in the sorter. The closure acts as a barrier which protects coins in the tray from flowing into the sorting mechanism while coins from a previous batch are being sorted.

Protecting the opening can be accomplished in a variety of ways. A hinged gate over the opening in a coin tray pivots to cover the opening so that a batch of coin may be dumped into the tray while the sorting mechanism processes a previous batch of coins. After the previous batch of coins has been sorted, the hinged gate pivots to uncover the opening so that the batch of coins in the tray may be processed. However, when the gate is closed, coins typically rest on top of the gate. Therefore, to open the gate, the coins must be moved. Additionally, some coins may not be counted because it is possible for coins to become lodged under an open gate. A "stopper" plug can also be used to protect the opening. However, unlike the hinged gate, the plug is separate from the tray and must be removed before coins may be processed. Therefore, the plugs are susceptible to loss.

A typical coin processing cycle includes preparing a batch of coins to be sorted, entering codes which identify the batch to be sorted, and sorting the coins. It would greatly accelerate the processing of consecutive coin batches if it were possible to multi-task the sorting process. Multi-tasking would enable all of the steps in the processing cycle to be carried out simultaneously. In the interest of increased throughput, a tray design requiring the minimum amount of manual operation would allow faster coin flow. This would free the operator to enter data and prepare the next batch for processing, as well as reduce the risk of accidentally mixing different batches of coins.

SUMMARY OF THE INVENTION

It is the primary object of the present invention to provide a coin tray that allows the efficient transfer of coins from the tray to a coin handling mechanism while minimizing the possibility of inadvertently mixing different batches of coins.

It is an important object of the present invention to provide a pivoting tray in accordance with the primary objective.

It is another object of the present invention to provide a coin tray which can be operated with one hand.

It is yet another object of the present invention to provide a pivoting coin tray that can be lowered during coin transfer without jamming coins in the tray.

To provide simple and efficient operation in accordance with the present invention, a coin tray includes a coin holding portion which is adapted to be pivotally mounted on a coin handling machine. The coin tray pivots between a coin holding position and a coin transferring position, and has an opening therein which allows coins to pass through the coin holding portion to a coin handling mechanism associated with the coin handling machine. The coin holding portion is preferably made from a lightweight material, such as plastic, and includes a handle for simple, one hand operation.

A barrier portion prevents coins on the coin holding portion from entering the opening when the coin holding portion is in the coin holding position. The barrier portion borders the opening, and is preferably stationary with respect to the coin handling machine. When the coin holding portion is lifted into the coin transferring position, the barrier portion allows coins on the coin holding portion to enter the opening. The interior of the barrier portion forms a chute which guides coins through the opening and into the coin handling mechanism.

BRIEF DESCRIPTION OF THE DRAWINGS

Other objects and advantages of the invention will become apparent upon reading the following detail description and upon reference to the drawings in which.

Figure 1:
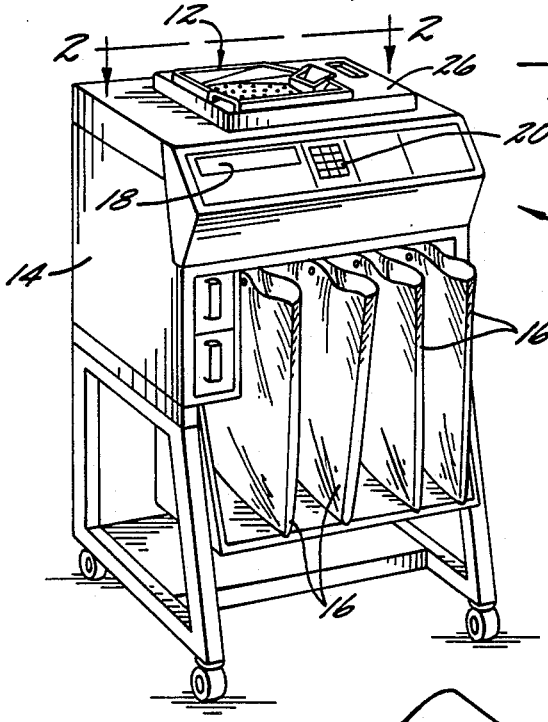
FIG. 1 is a perspective view of a coin sorting machine having a coin tray in accordance with the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Referring initially to FIG. 1, a coin sorter is generally designated by a reference numeral 10. The coin sorter 10 includes a coin tray 12 in which coins are held prior to sorting and during sorting. The tray 12 transfers coins to a sorting mechanism (not shown) which is situated within a cabinet 14. The sorting mechanism transfers sorted coins to a plurality of currency bags 16 which are attached below the cabinet 14.

A display 18 and a keypad 20 interact with electronic circuity within the cabinet 14. The electronic circuitry determines the coin totals during sorting, controls the termination of coin sorting, and calculates pertinent data regarding the sorted coins. Instructions to the electronic circuitry are input via the keypad 20 and information is presented to the operator via the display 18. Operators commonly insert identification codes to identify particular transactions or batches of coins.

During consecutive batch sorting operations, an operator dumps coins into the tray 12 and inputs an identification number along with any additional data via the keypad 18. The operator then transfers the coins within the tray 12 to the sorting mechanism. While the coins are being sorted, the operator dumps the next batch of coins into the tray 12 and enters data corresponding to the next batch.

Figure 4:
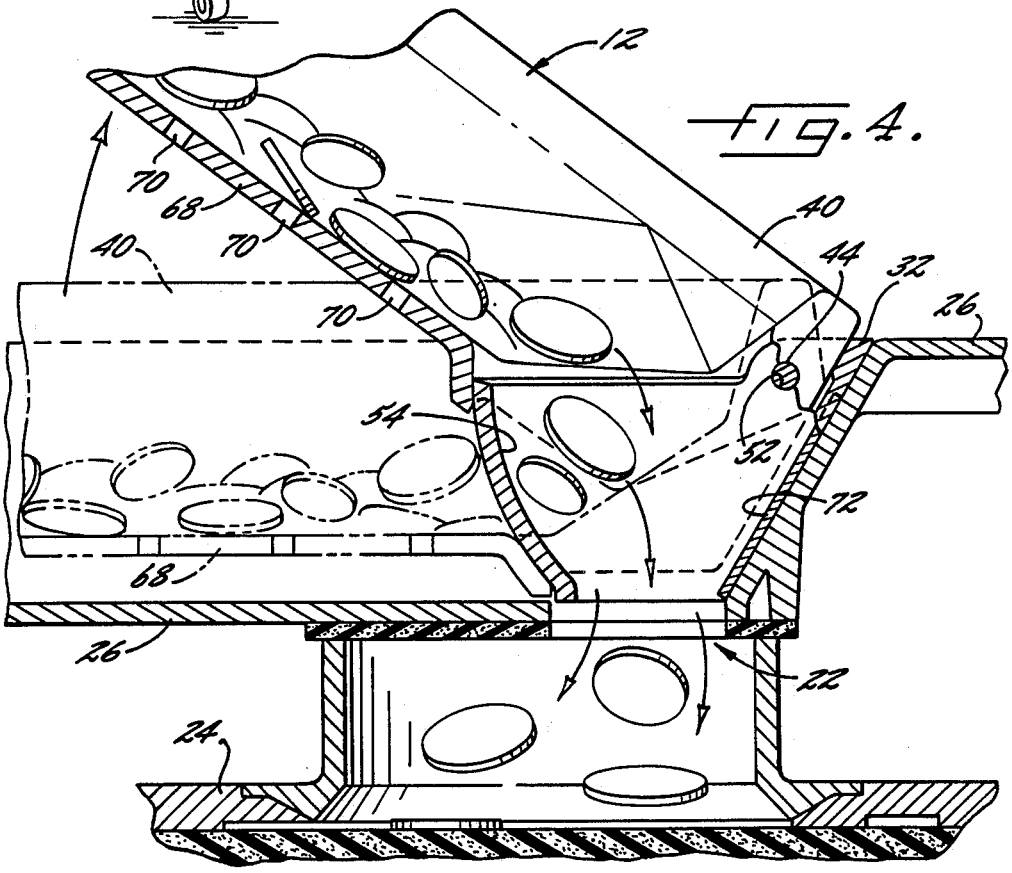
FIG. 4 is a cross-sectional view of a hinged portion of the coin tray taken along line 3–3 in FIG. 2.
Figure 2:
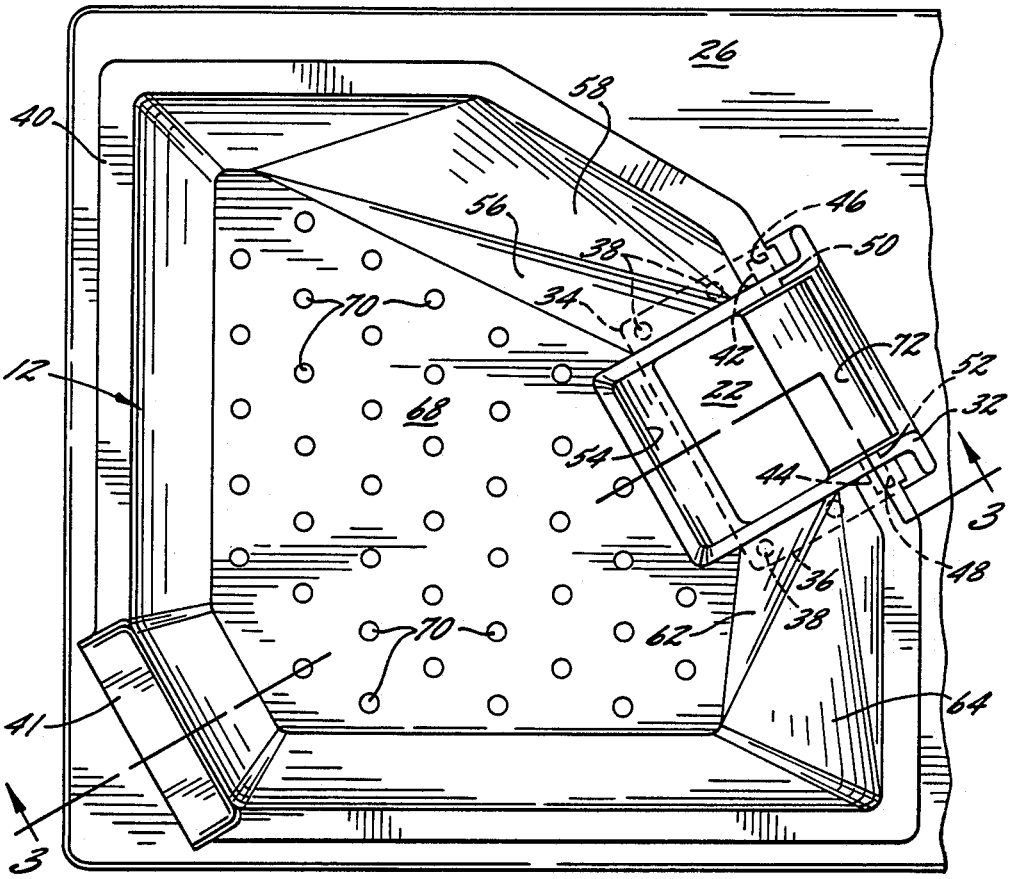
FIG. 2 is a top plan view of the coin tray taken at line 2—2 in FIG. 1.
Figure 3:
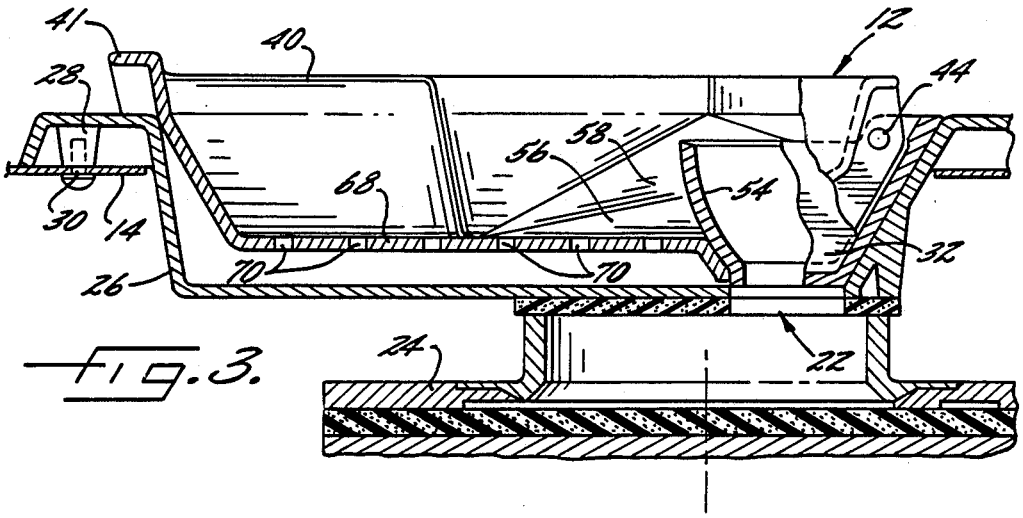
FIG. 3 is a cross-sectional view of the coin tray taken along line 3—3 in FIG. 2

To enable the operator to quickly and efficiently transfer coins from the tray 12 to the sorting mechanism, the tray 12 pivots upwardly. As shown in FIGS. 2, 3 and 4, the tray 12 dumps the coins into an opening 22 which leads to a sorting mechanism 24. The tray 12 includes a base portion 26 which mounts to the top of the cabinet 14 via a plurality of bosses 28. The bosses 28 are affixed to the underside of the base portion 26 and extend through apertures 30 in the top of the cabinet 14. A barrier portion 32 of the tray 12 is mounted to the base portion 26 to protect the opening 22 from accidentally receiving coins when the tray is in its lowered position. Preferably, the barrier portion 32 includes two flanges 34,36, and mounting is accomplished by bolts (not shown) which extend through respective apertures 38 in the flanges 34,36 and into the bottom of the base portion 26.

A portion 40 of the tray 12 is pivotally mounted to the barrier portion 32 by two dowels 42,44 which are press-fit into respective recesses 46,48 formed in the pivoting portion 40. Each dowel 42,44 is inserted through respective apertures 50,52 in the barrier portion 32, once the apertures 50,52 are aligned with the respective recesses 46,48, and the dowels are pressed into the recesses 46,48. Preferably, each dowel 42,44 has a knurled end which is inserted into the recess and a smooth end on which the pivoting portion 40 pivots. Since both ends are of substantially the same diameter, the apertures 50,52 are slightly larger in diameter than the recesses 46,48 to allow the dowels 42,44 to be inserted as described above.

When coins are deposited into the pivoting portion 40 of the tray 12, the barrier portion 32 surrounds the opening 22 an prevents any of the coins from entering the opening 22. As best illustrated in FIG. 4, the operator transfers coins from the pivoting portion 40 to the sorting mechanism 24 by raising the pivoting portion 40 using a handle 41. When the level of coins is higher than the top of the barrier portion 32, the coins flow down the incline formed by the raised pivoting portion 40 and into the interior of the barrier portion 32. The interior of the barrier portion 32 forms a chute 54 which leads to the sorting mechanism 24.

To prevent coins from bouncing out of the pivoting portion 40 of the tray 12 during coin transfer, the walls 56,58,62,64 of the pivoting portion 40 which are nearest the barrier portion 32 form a funnel-like passage. These walls smoothly transfer the coins into the chute 54 without abruptly changing the direction of the flowing coins. The pivoting portion 40 includes a lower surface 68 which is relatively flat. The walls 56 and 62 intersect the surface 68 to form a large obtuse angle, so that the walls 56 and 64 smoothly direct the coins on the surface 68 toward the chute 54. The walls 58 and 64 intersect with the walls 56 and 62, respectively, to form a large obtuse angle which smoothly directs coins from the walls 56 and 62 into the chute 54. While the drawings illustrate a plurality of walls, the transition from the flat surface 68 to the opening 22 can also be formed by a curved surface.

If the operator wishes to discontinue coin transfer, the operator lowers the pivoting portion 40 of the tray 12 until the level of the coins is no longer above the top of the barrier portion 32. Since the chute 54 formed by the barrier portion 32 is relatively small compared to the size of the pivoting portion 40 of the tray 12, few coins fall into the sorting mechanism 24 after the pivoting portion 40 is lowered.

The pivoting portion 40 further includes a plurality of perforations 70 which are formed in the surface 68. The perforations 70 allow debris smaller than the diameter of the perforations 70 to fall through the surface 68 and onto base portion 26. The perforations are typically about ⅜ in diameter (i.e., about one half of the diameter of a dime), and are primarily used to filter out dirt and small objects so that the sorting mechanism is protected from damage.

To protect the sorting mechanism from damage caused by ferromagnetic objects, a soft magnet 72 is attached to at least one wall of the chute 54. Objects such as steel screws and washers, which are too large to filter through the perforations 70, are attracted to the magnet 72. The magnet 72 holds the objects until the operator removes them. While the magnet 72 is shown affixed to one wall of the chute 54, an entire chute 54 made from magnetic material also effectively prevents ferromagnetic objects from entering the sorting mechanism 24.

The tray 12 is preferably formed from a lightweight material so that operators can easily lift the pivoting portion 40 during coin transfer. Injection molded plastic forms a lightweight, rigid and structurally sound tray which is easy to use and inexpensive to manufacture. An injection molded plastic tray tested by the inventor weighed about 7 pounds, while a cast aluminum tray tested by the inventor weighed about 16 pounds. Of course, any suitable material may be used to fabricate the tray 12, but strong, lightweight materials are preferred.

I claim:

1. In a coin handling machine, a tray for holding coins to be fed into the machine, said tray having a bottom wall and side walls extending upwardly therefrom, a coin feed chute disposed adjacent one side of said tray with at least a portion of the side walls of said chute extending above the bottom wall of said tray and forming a portion of the side walls of said tray, said tray being pivotally mounted for raising the bottom of the tray upwardly along and to at least the top of the side walls of said chute so that coins in said tray will slide downwardly along the bottom wall of said tray and over the side wall of said chute and into said chute, when the tray is pivoted upwardly.

2. The coin handling machine of claim 1 wherein the tray is pivoted adjacent the top of the side wall of the chute farthest away from the center of the tray.

3. The coin handling machine of claim 1 wherein the side walls of the tray slope inwardly toward the top opening of the chute when the tray is in its raised position, so that the tray side walls funnel coins from the tray into the chute.

4. The coin handling machine of claim 1 wherein the tray includes a flange extending downwardly from the bottom wall of the tray along the outer surface of the adjacent side wall of the chute so that when the tray is in its raised position the flange overlaps the top portion of the side wall of the chute to avoid any gap therebetween.

* * * * *

UNITED STATES PATENT AND TRADEMARK OFFICE

CERTIFICATE OF CORRECTION

PATENT NO. : 4,964,495

DATED : October 23, 1990

INVENTOR(S) : James M. Rasmussen

It is certified that error appears in the above-identified patent and that said Letters Patent is hereby corrected as shown below:

On the title page item [21] Appl. No.: "336,080" should read --333,608--.

Signed and Sealed this

Seventeenth Day of March, 1992

*Attest:*

HARRY F. MANBECK, JR.

*Attesting Officer*

*Commissioner of Patents and Trademarks*